US006324983B1

(12) United States Patent
Dindl

(10) Patent No.: US 6,324,983 B1
(45) Date of Patent: Dec. 4, 2001

(54) SUB-CALIBER PROJECTILE FOR LOW IMPULSE CARTRIDGES

(75) Inventor: Frank J. Dindl, Wharton, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/632,007

(22) Filed: Aug. 3, 2000

Related U.S. Application Data

(60) Provisional application No. 60/152,136, filed on Aug. 19, 1999.

(51) Int. Cl.[7] ..... F42B 3/00; F42B 3/06

(52) U.S. Cl. ..... 102/447; 102/447; 102/444; 102/445; 102/446; 102/430; 102/464; 102/469; 102/470; 89/29

(58) Field of Search ..... 102/447, 444, 102/430, 445–446, 464, 469, 470; 89/29

(56) References Cited

U.S. PATENT DOCUMENTS

| | | | | |
|---|---|---|---|---|
| H114 | * | 8/1986 | Quintavalle | 102/513 |
| 3,744,420 | * | 7/1973 | Barr . | |
| 4,686,905 | * | 8/1987 | Szabo | 102/444 |
| 4,862,805 | * | 9/1989 | Szabo | 102/444 |
| 5,359,937 | * | 11/1994 | Dittrich | 102/430 |
| 5,677,505 | * | 10/1997 | Dittrich | 89/29 |
| 5,834,681 | * | 11/1998 | DuBay | 102/430 |
| 5,983,773 | * | 11/1999 | Dionne | 89/29 |
| 6,095,051 | * | 8/2000 | Saxby | 102/444 |

* cited by examiner

*Primary Examiner*—Michael J. Carone
*Assistant Examiner*—Lulit Semunegus
(74) *Attorney, Agent, or Firm*—John F. Morgan; Michael Spachs

(57) ABSTRACT

A sub-caliber projectile cartridge for automatic weapons includes a case, a piston, a forward cavity/an inner bore in the piston, a sub-caliber projectile, and a link. The sub-caliber projectile is seated into the forward cavity/inner bore located in the forward portion of the piston. Gas passages permit propellant gases to bleed into the cavity behind the sub-caliber projectile and to accelerate the sub-caliber projectile upon firing. The case and piston are assembled and telescopically secured by means of a crimp or another similar feature, to allow relative movement therebetween during chambering and firing. The link may be allowed to move for some portion of the required relative travel between the link and the base of the case. A shoulder on the piston provides a stop through which reaction loads are transmitted to the rear of the barrel during chambering and firing. The piston telescopes over the case during chambering to provide the relative movement between the link and the case base required for weapon function. Upon firing, the expanding propellant gases force the case and piston to telescope open. Propellant gases are also used to expel the sub-caliber projectile. Reaction loads are applied to the rear of the barrel through the shoulder, and at the same time are applied to the bolt, driving it rearward to cycle the weapon. The cartridge can be used in automatic weapon systems including but not limited to the 40mm MK19 Grenade Machinegun.

6 Claims, 12 Drawing Sheets

SUB-CALIBER PROJECTILE FOR LOW IMPULSE CARTRIDGES

RELATED APPLICATIONS

This application claims benefit of filing date Aug. 19, 1999 of provisional application No. 60/152,136, the entire file wrapper contents of which application are herewith incorporated by reference as though fully set forth herein at length.

CROSS-REFERENCE TO RELATED APPLICATION

The present invention relates to U.S. patent application Ser. No. 09/351,978 to Frank Dindl, titled "Low Impulse Telescoping Cartridge", filed on Jul. 12, 1999, now patented, U.S. Pat. No. 6,178,889 B1 and commonly assigned to the assignee of the present invention, which is incorporated herein by reference in its entirety.

GOVERNMENT INTEREST

The invention described herein may be manufactured and used by, or for the Government of the United States for governmental purposes without the payment of any royalties thereon.

FIELD OF THE INVENTION

The present invention relates in general to the field of ammunition, and it particularly relates to a sub-caliber projectile for low impulse cartridges used in automatic weapons. More specifically, the present invention relates to a sub-caliber projectile cartridge for use in automatic weapon systems such as the 40 mm MK19 Grenade Machinegun, though the inventive concept is applicable to any caliber of weapon and ammunition.

BACKGROUND OF THE INVENTION

Automatic weapons such as the 40 mm MK19 Grenade Machinegun are designed to use ammunition with a specific external envelope. The external dimensions of a sub-caliber projectile cartridge must be compatible with the weapon from which it is fired. The cartridge configuration must also withstand the forces encountered during weapon feeding and cycling.

Sub-caliber projectiles are typically used for applications such as inexpensive training ammunition and applications where reduced terminal effects or reduced target damage are desired. Conventional projectiles include sub-caliber training devices and ammunition for large caliber artillery, howitzers and tank guns. These applications are designed for single shot weapon mechanisms and do not address the full automatic weapon operation typical of machineguns such as the 40 mm MK19 Grenade Machinegun.

There is a great and still unsatisfied need for a sub-caliber projectile cartridge for use in automatic weapons. Exemplary sub-caliber projectile applications include non-lethal projectiles and sub-caliber projectiles, short range training ammunition, and low cost training ammunition.

SUMMARY OF THE INVENTION

One feature of the present invention to satisfy this long felt need is to provide a low impulse sub-caliber projectile cartridge with an external configuration which is compatible with conventional automatic weapon systems such as the 40 mm MK19 Grenade Machinegun.

This allows for the launching of low velocity and/or low mass projectiles or sub-caliber projectiles such as limited range training projectiles, low cost training projectiles, non-lethal rubber balls, batons, rubber projectiles, powders, and a variety of other low impulse projectile configurations, while functioning the MK19 Grenade Machinegun or other firearms in a fully automatic mode. Low impulse refers to the relative ammunition impulse of the sub-caliber projectile configuration relative to the ammunition impulse of the full caliber ammunition for which the weapon was designed.

A further feature of the present invention is to provide a fully automatic weapon function without requiring changes to the weapon itself, while permitting effective firing of reduced velocity and/or reduced mass projectiles.

These and other features and advantages of the present invention are achieved by a sub-caliber projectile cartridge that includes a sub-caliber projectile mechanism comprised of a cavity/inner bore in the forward portion of the cartridge containing the sub-caliber projectile. The cartridge nose configuration provides the external shape required for compatibility with the weapon while allowing the launching of the sub-caliber projectile.

The operation of the 40 mm MK19 Grenade Machinegun using the cartridge of the present invention is as follows: The cartridge travels through the weapon feed mechanism. The outside configuration of the cartridge and the position of the link is preferably constrained to that of conventional ammunition in order to be compatible with the weapon. The link and cartridge are restrained during the delinking operation and cartridge pickup, as the bolt reaches the battery position. As the bolt is returned rearward, the cartridge is cammed down the bolt face into alignment with the barrel.

As the bolt moves forward to the battery position, the cartridge is chambered. Upon firing, the sub-caliber projectile is fired from the nose of the cartridge. Expanding propellant gases from the primary propellant charge in the base of the cartridge case or from a secondary charge in the base of the sub-caliber projectile cavity/inner bore propels the sub-caliber projectile from the inner bore and launches the sub-caliber projectile from the weapon.

Reaction loads are applied to the barrel through the shoulder and through the base of the cartridge to the bolt. The energy imparted to the bolt accelerates the bolt rearward and cycles the weapon.

The present invention enables the practical and efficient use of sub-caliber projectile ammunition in an unmodified automatic weapon such as the MK19 Grenade Machinegun. In one embodiment, the secondary propellant charge can be used as an alternative to bleeding propellant gases from the primary propellant charge, in order to accelerate the projectile.

In another embodiment, the sub-caliber projectile can be contained within a sub-caliber cartridge case which is held within the forward inner bore. The sub-caliber cartridge case can be used to hold the piston and case in the open position until the cartridge is chambered. The sub-caliber cartridge case can be used to control the forces required to accomplish telescoping the cartridge to the closed position. The sub-caliber cartridge case can also be assembled with a primer, propellant, and sub-caliber projectile prior to insertion into the forward inner bore to accomplish cartridge assembly.

BRIEF DESCRIPTION OF THE DRAWINGS

The features of the present invention and the manner of attaining them will become apparent, and the invention itself will be understood by reference to the following description and the accompanying drawings. In these drawings, like numerals refer to the same or similar elements. The sizes of the different components in the figures might not be in exact proportion, and are shown for visual clarity and for the purpose of explanation.

DETAILED DESCRIPTION OF THE INVENTION

Figure 1:
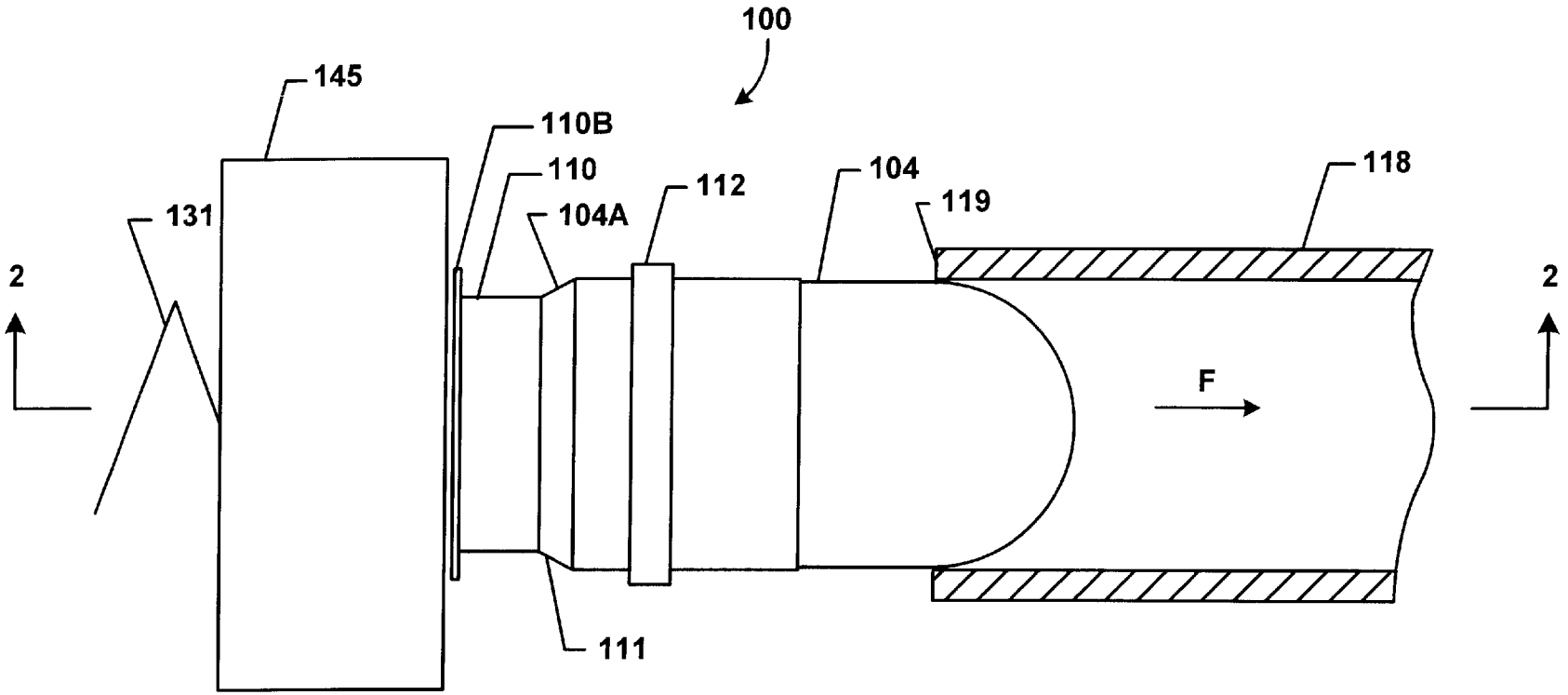
FIG. 1 is a side elevational view of a sub-caliber projectile cartridge according to the present invention. This embodiment includes a sub-caliber cartridge case contained within the forward inner cavity.
Figure 2:
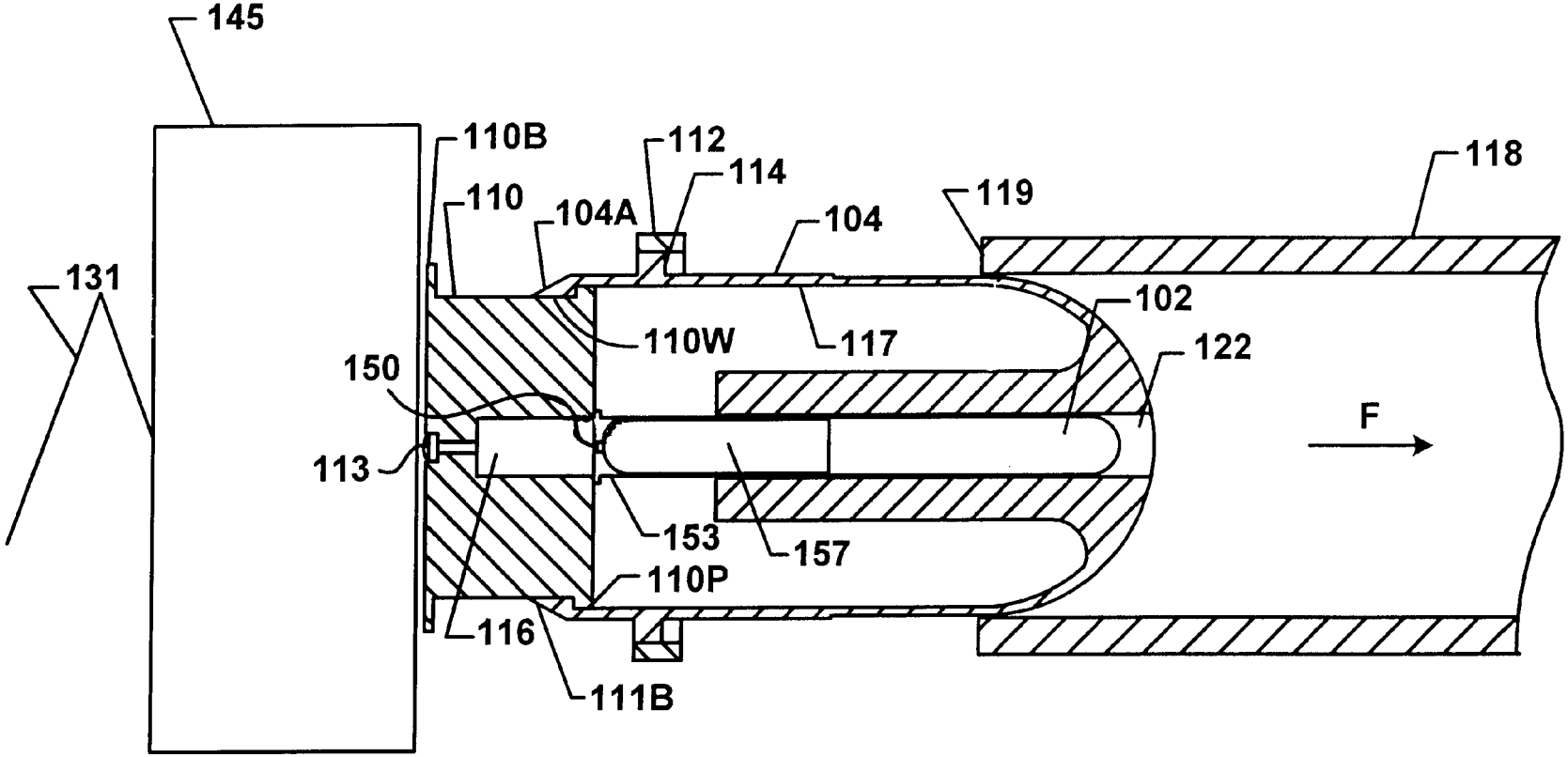
FIG. 2 is a cross-sectional view of the sub-caliber projectile cartridge of FIG. 1 taken along line 2—2, illustrating the cartridge configuration during chambering.
Figure 3:
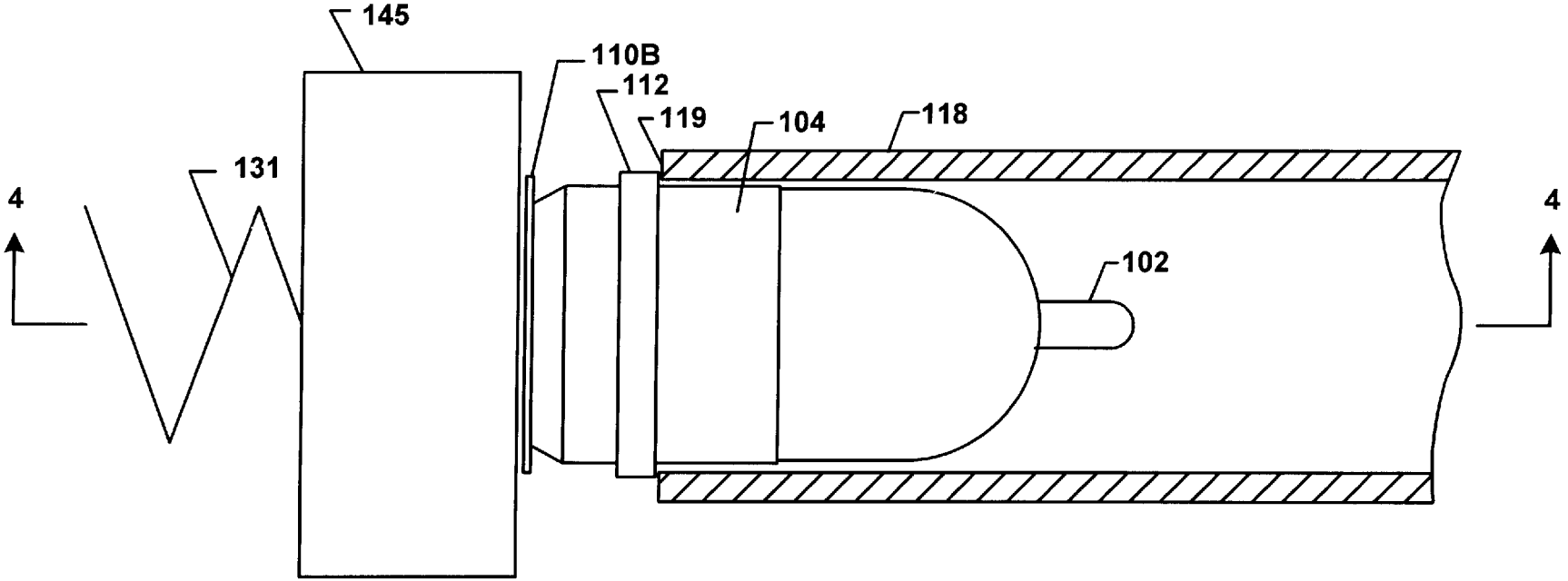
FIG. 3 is a side elevational view of the cartridge of FIGS. 1 and 2, shown fully chambered.

A low impulse, telescoping cartridge 100 according to a first embodiment of the present invention is depicted in FIGS. 1 through 6. With particular reference to FIGS. 1, 2 and 3, the cartridge 100 is generally comprised of five main components: a sub-caliber projectile 102, a forward cavity (or inner bore) 122, a piston 104, a case 110, and a link 112.

The cartridge case 110 contains a primer 113 to provide ignition. A propellant 116 provides the required propulsion energy to function the weapon. A crimp 111 or another similar or equivalent feature, secures the case 110 relative to the piston 104, in such a manner to allow for the cartridge 100 telescoping function, which prevents the cartridge case 110 from separating from the piston 104, and which further prevents cartridge telescoping during the delinking process while feeding.

The overall outer configuration of the cartridge 100 matches the outer configuration of conventional ammunition where the cartridge interfaces with the weapon, to the extent necessary for reliable weapon operation. The cartridge case 110 fits into the rear portion 104R of the piston 104 such that a portion of the outer wall 110W of the cartridge case 110 mates with the inner wall 117 of the piston 104, to provide a seal for containing the propellant gases.

The piston 104 further includes a shoulder 114 that protrudes outwardly from the periphery of the piston 104 to provide a stop for the barrel 118 when the cartridge 100 is fully chambered. The shoulder 114 limits the travel distance of the piston 104 within the barrel 118. The shoulder 114 also provides a mechanism through which the reaction forces are transmitted from the piston 104 to the rear surface or breech 119 of the barrel 118.

During firing, the expanding propelling gases force the piston 104 to telescope open relative to the piston 104. The shoulder 114 provides the load path for reacting against the barrel 118. Simultaneously, the case 110 provides a load path to react against a bolt 145 in order to function the weapon in a fully automated mode.

The expanding propellant gases in this embodiment from the primary propellant charge 116, ignite the secondary propellant charge 157 directly or by initiating a secondary primer 150. Alternatively, a vent hole may be used in place of the secondary primer 150 to allow ignition of the secondary propellant charge 157 directly. Another alternative embodiment uses a vent hole in place of the secondary primer 150 and secondary propellant charge 157. The propellant gases from the primary propellant charge 116 bleed through the vent hole and act against the sub-caliber projectile 102 directly.

The link 112 provides a mechanism for assembling a number of cartridges 100 into a belt of ammunition. The weapon design determines in large part the permissible shape and size of the link 112. The shoulder 114 is contained within, or covered by the link 112, such that the shoulder 114 does not interfere with the weapon feeding operation.

The cartridge 100 telescoping function provides the mechanism for allowing the relative movement between the link 112 and the cartridge case 110 during chambering. This relative movement can be accomplished through the cartridge case 110 and piston 104 telescoping alone, or through a combination of the cartridge 100 telescoping and the movement of the link 112.

While the link 112 is allowed to move, according to another embodiment, the link 112 is fixed to the piston 104. According to yet another embodiment, a collapsing cartridge case replaces the telescoping function. In still another embodiment, the telescoping open stroke (i.e., the travel distance) is different from the telescoping closed stroke.

The cartridge 100 is assembled by inserting the propellant 116 and the primer 113 in the case 110. The base 111B of the piston 104 is crimped over a flange 110F of the case 110 to secure the piston 104 and the case 110 is a telescoping relationship. If a separate propellant charge is needed, additional propellant 157 is placed inside the piston 104. The sub-caliber projectile 102 is inserted into the inner bore in the piston 104. The link 112 is assembled by sliding it over the projectile 102 and part of the piston 104. The link 112 is fitted over the shoulder 114.

Having described the general components of the cartridge 100, its operation or use will now be explained in connection with FIGS. 1–6 and 7–12. The use of the cartridge 100 can be separated into three general stages: feeding; chambering; and firing.

Feeding

The feeding stage is illustrated in FIGS. 1 and 2. In this stage, the cartridge 100 is in the fully extended or "telescope open" position. A drive spring 131 pushes against a bolt 145, which, in turn, pushes the cartridge 100 inside the barrel 118, in the direction of the arrow F.

In the case of the 40 mm MK19 Grenade Machinegun, during the feeding stage, the cartridge 100 resists telescoping in the delinking process of the weapon operation. The interface between the piston 104 and the cartridge case 110 provides a crimp 111, adhesive or other means of preventing the case 110 and piston 104 from telescoping until the cartridge 100 is chambered.

Chambering

Figure 4:
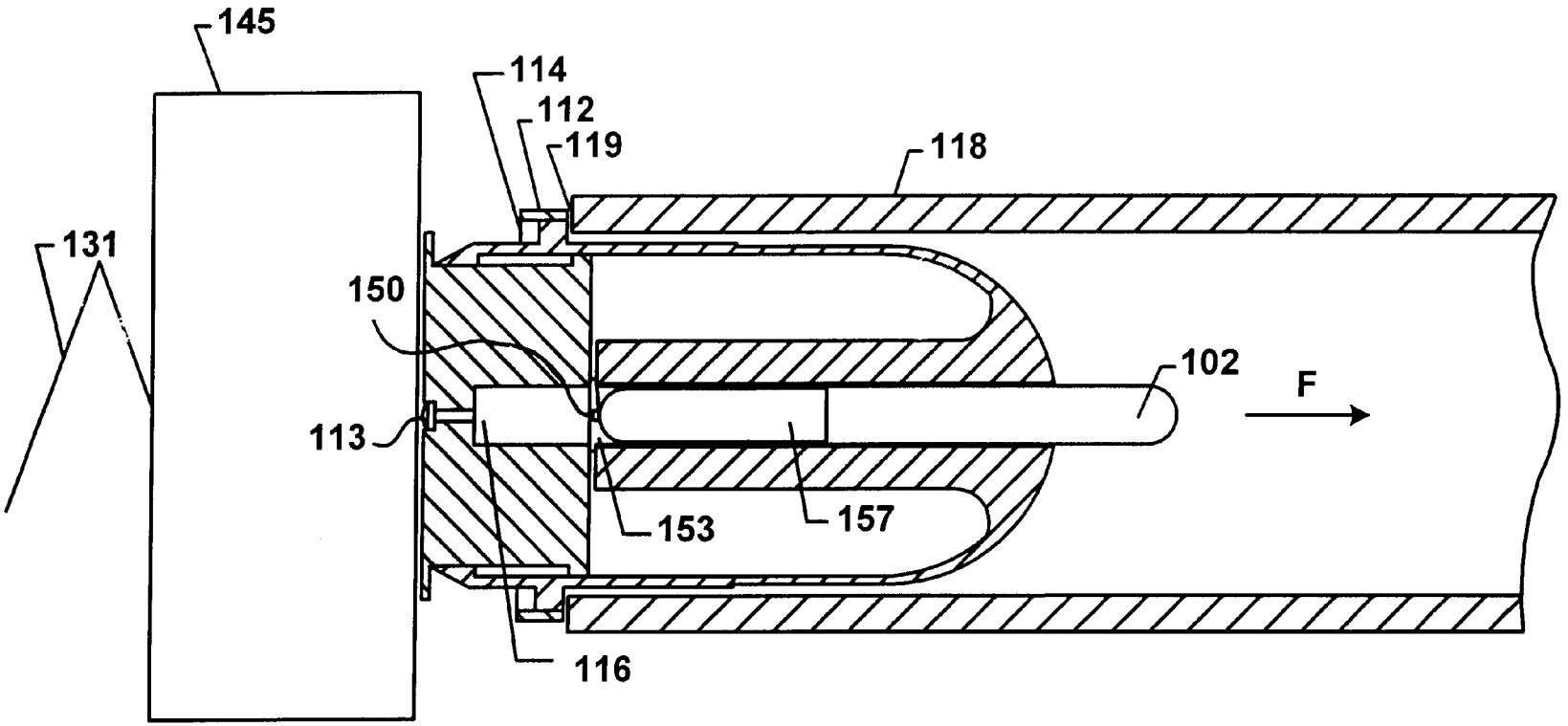
FIG. 4 is a cross-sectional view of the cartridge of FIG. 3 taken along line 4—4.

The chambering stage is illustrated in FIGS. 3 and 4. As the cartridge 100 is chambered, the shoulder 114 contacts the rear surface or breech 119 of the barrel 118. The resistance exerted by the crimp 111 at the interface between the piston 104 and the cartridge case 110 is overcome, and the piston 104 and the cartridge case 110 telescope to the closed (or compacted) position.

The sub-caliber cartridge case 153 may be used to provide the resistance required to hold the piston 104 and the case 110 in the normally open position until chambering. The sub-caliber cartridge case 153 configuration also allows the sub-caliber projectile 102, propellant charge 157, primer 150 and sub-caliber cartridge case 153 to be assembly prior to insertion into the forward inner bore 122 to facilitate cartridge 100 manufacture.

The link 112 may also be allowed to move rearward toward the base 110B of the case 110 such that the combination of cartridge telescoping and link movement position the link 112 at the case 110 position required by the weapon for firing.

Firing

Figure 5:
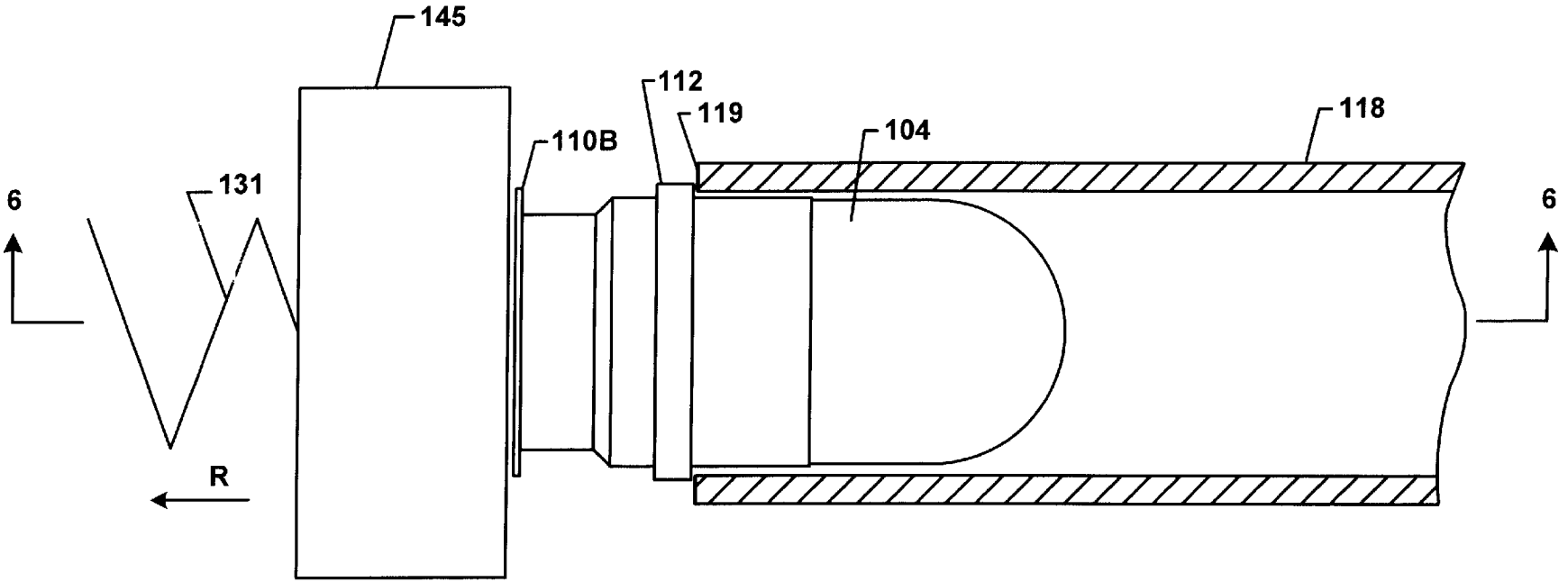
FIG. 5 is a side elevational view of the cartridge of FIGS. 3–4, shown after firing.
Figure 6:
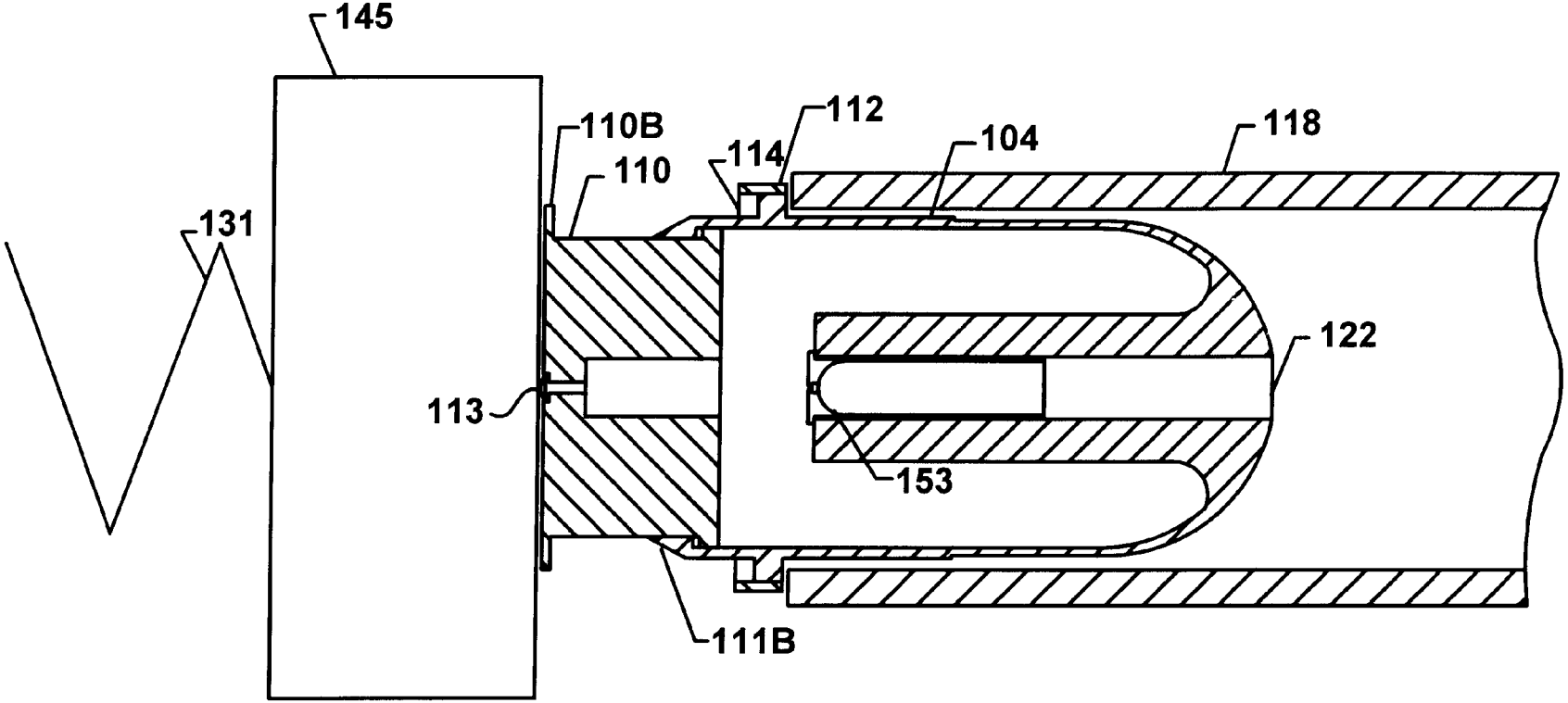
FIG. 6 is cross-sectional view of the cartridge of FIGS. 3–4, taken along line 6—6, shown after firing.
Figure 7:
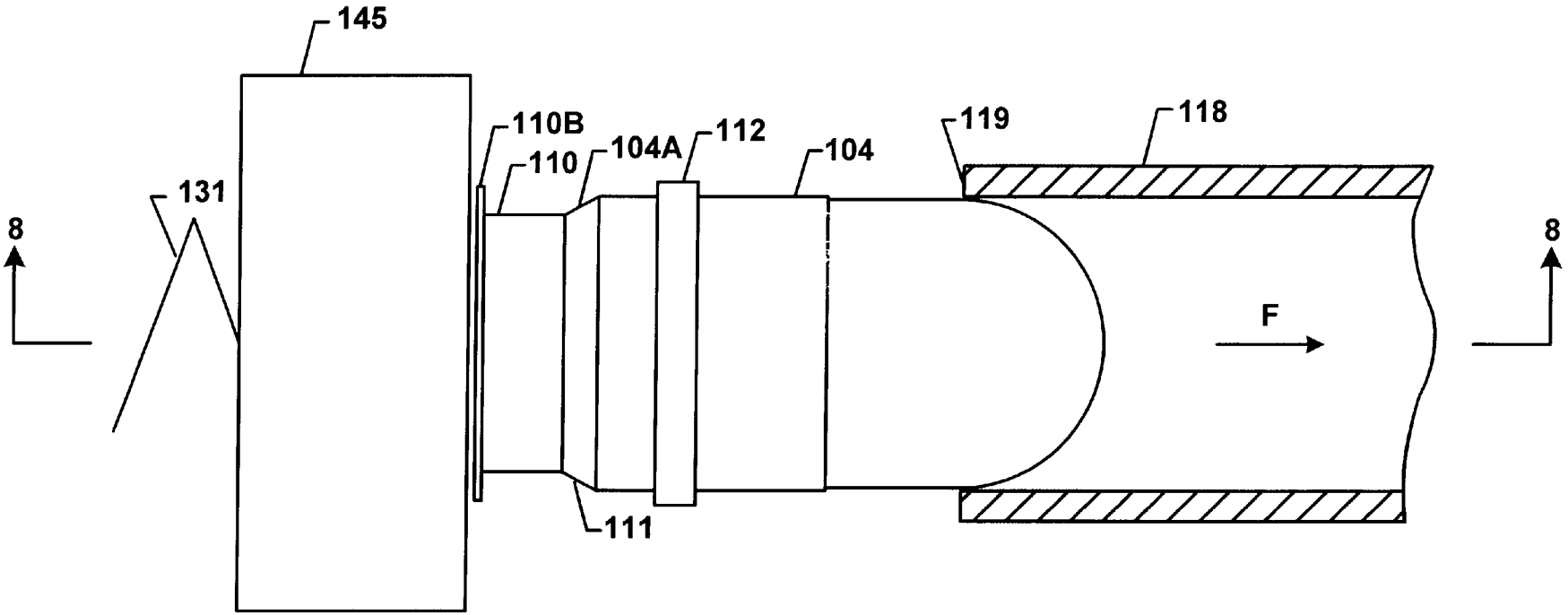
FIG. 7 is a side elevational view of a sub-caliber projectile cartridge according to the present invention, wherein the sub-caliber projectile is contained within a fixed forward inner bore where the sub-caliber cartridge assembly is integral to the piston.
Figure 8:
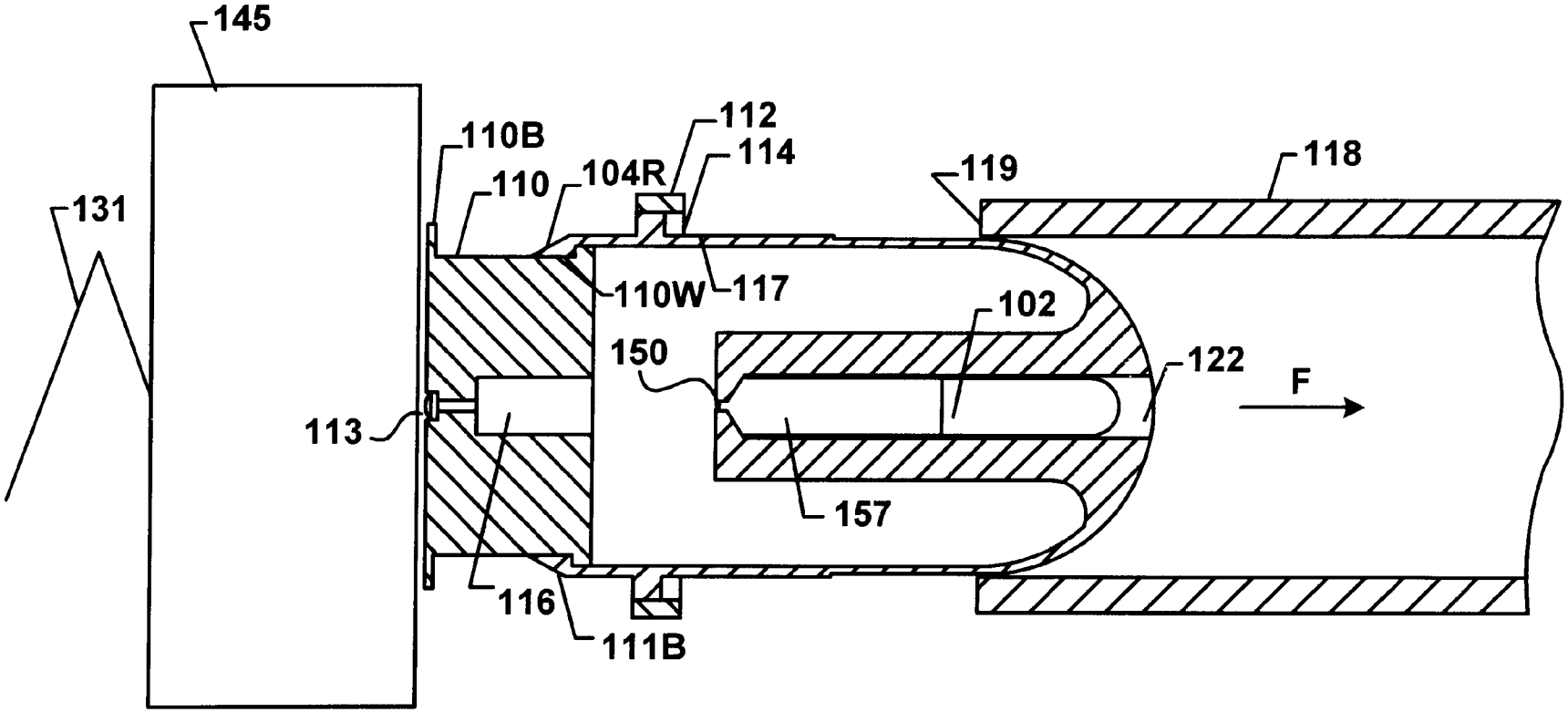
FIG. 8 is a cross-sectional view of the sub-caliber projectile cartridge of FIG. 7 taken along line 8—8, illustrating the cartridge configuration during chambering.
Figure 9:
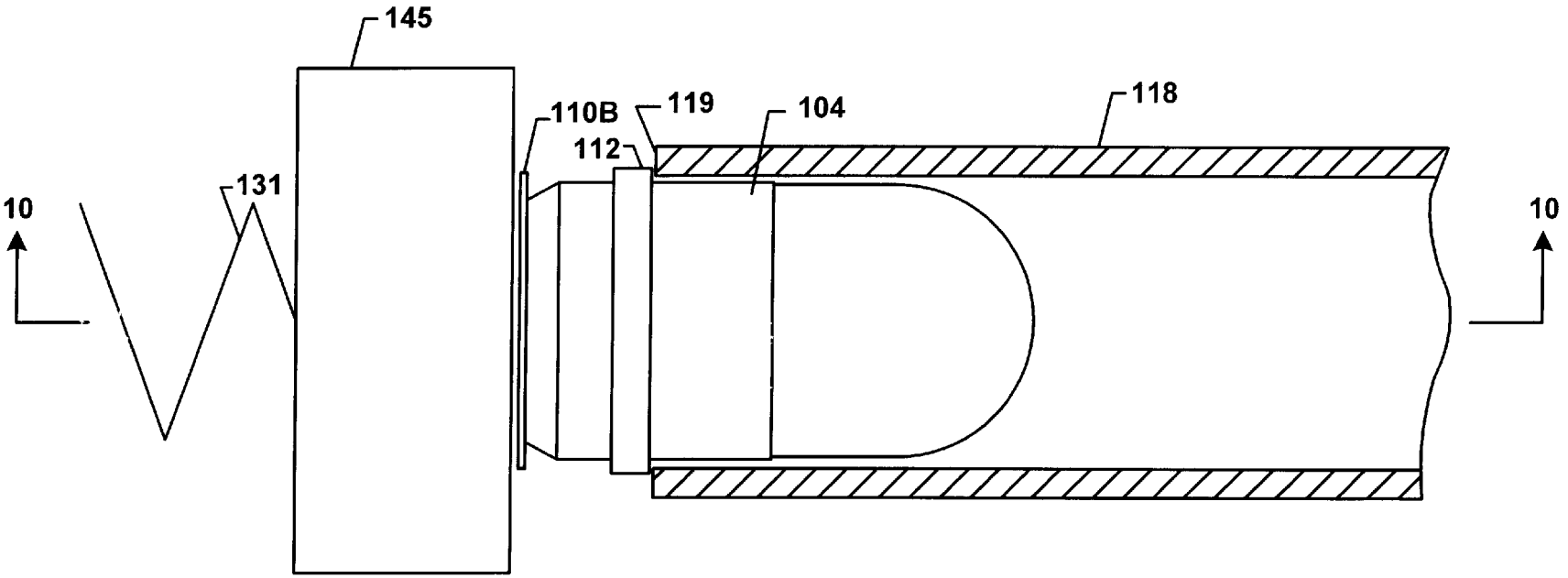
FIG. 9 is a side elevational view of the cartridge of FIGS. 7 and 8, shown fully chambered.
Figure 10:
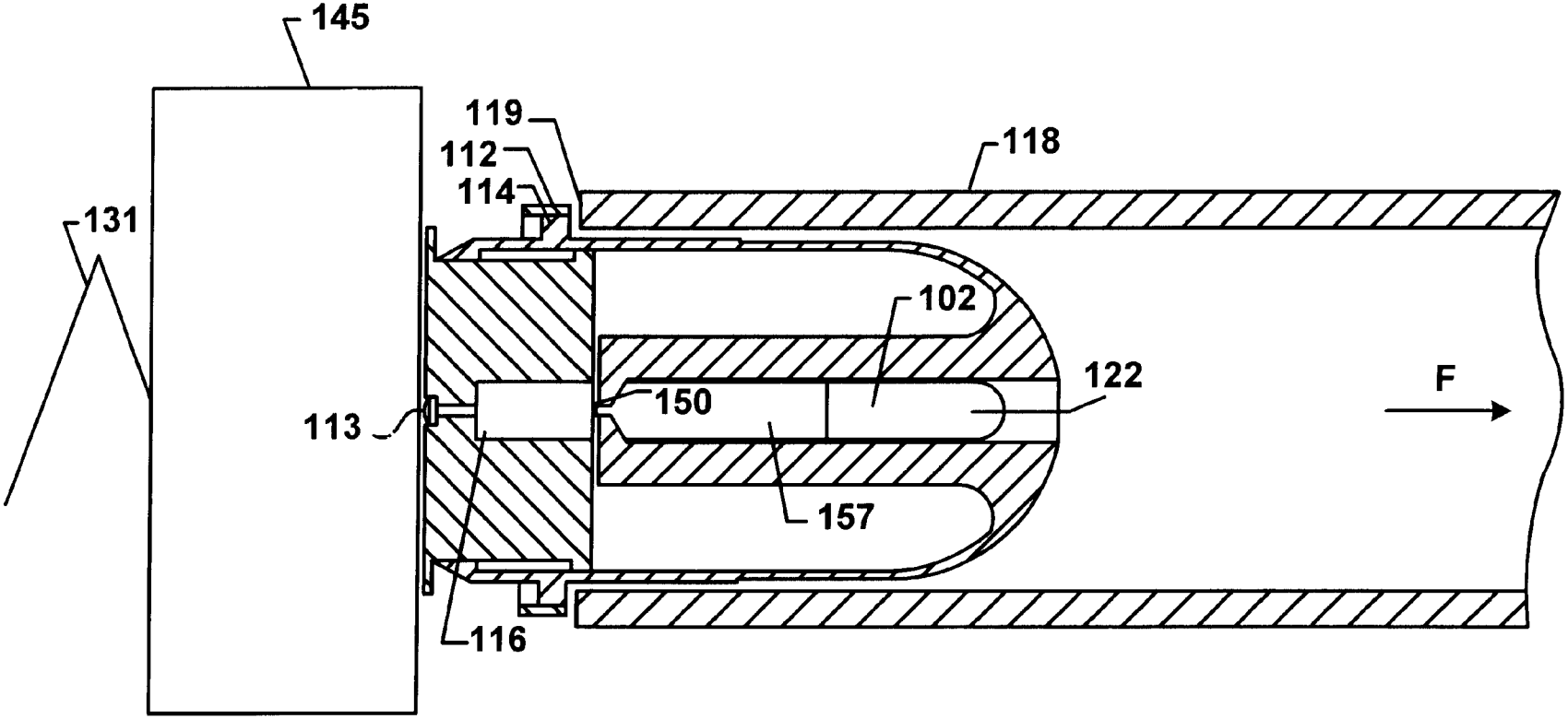
FIG. 10 is a cross-sectional view of the cartridge of FIG. 9 taken along line 10—10.
Figure 11:
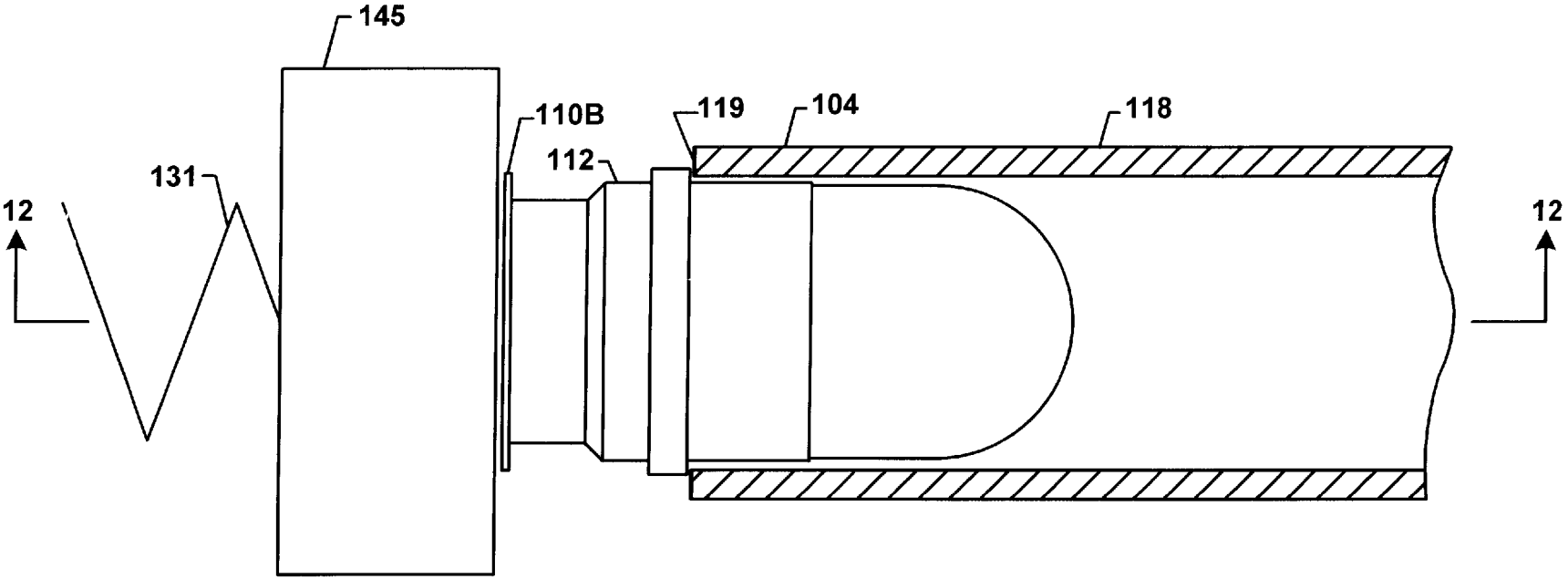
FIG. 11 is a side elevational view of the cartridge of FIGS. 9–10, shown after firing.
Figure 12:
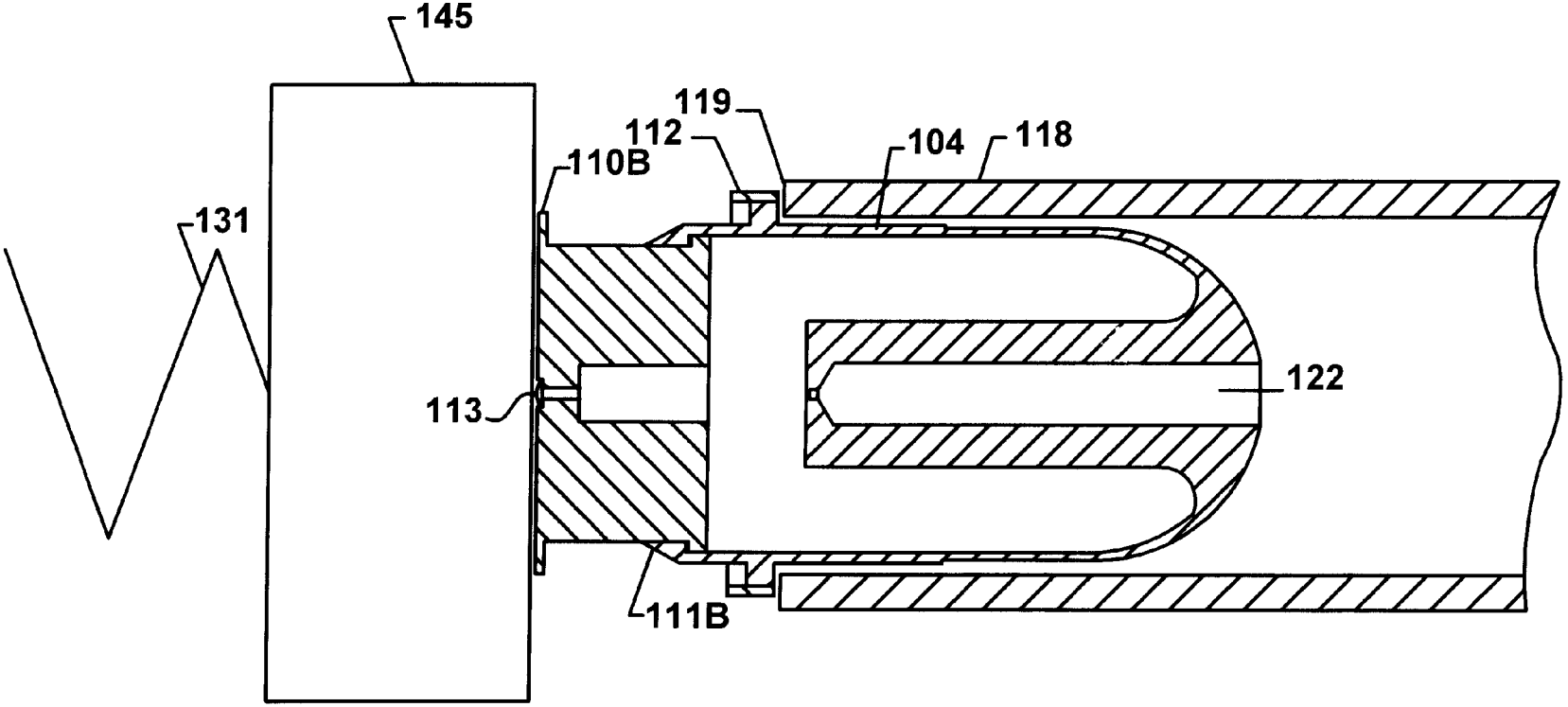
FIG. 12 is cross-sectional view of the cartridge of FIG. 11, taken along line 12—12, shown after firing.

The firing stage is illustrated in FIGS. 5 and 6. Upon ignition of the primer 113, the propellant 116 ignites and pressurizes the cartridge 100. The shoulder 114 is restrained by the breech 119 of the barrel 118. The expanding propellant gases force the cartridge case 110 rearward in the direction of the arrow R. This, in turn, accelerates the bolt 145 to the rear, and compresses the drive spring 131 for cycling the weapon.

Propellant gases bled through to the base of the sub-caliber projectile 102 or a forward propellant charge 157 ignited directly, or through a forward primer 150 by the hot, high pressure propellant gases from the primary propelling charge 116, cause the sub-caliber projectile 102 to be expelled from the forward cavity 122 in the direction of the arrow F.

The case 110 is displaced rearward in the direction of the arrow R, until the cartridge 100 telescopes to the fully open position. Provisions may be made to allow venting of the gas pressure through vents 221 in the piston 104 as the cartridge 100 telescopes to the fully open position so that the crimp 111 (or other mechanism) used to secure the case 110 to the piston 104 can be minimized. The bolt 145 continues traveling rearward, extracting and ejecting the cartridge 100 from the weapon in the same manner as a conventional cartridge case.

The embodiments described herein are included for the purposes of illustration, and are not intended to be the exclusive; rather, they can be modified within the scope of the invention. Other modifications may be made when implementing the invention for a particular application.

What is claimed is:

1. A low impulse cartridge for use in a weapon including a barrel, the cartridge comprising:

a case;

a piston slidably disposed relative to the case;

a shoulder protruding outwardly from a periphery of the piston to provide a stop surface for a barrel when the cartridge is chambered;

an inner bore formed in the piston for containing a sub-caliber projectile;

wherein the piston is in a normally telescoping open position;

wherein the piston telescopes in a closed position during chambering, whereupon the barrel is forced against the shoulder, so that the shoulder provides a load path for reacting against the barrel;

wherein the piston telescopes in the open position after firing;

and wherein the forward inner bore contains the sub-caliber projectile.

2. A cartridge according to claim 1, further including a link that enables linking of a plurality of cartridges into a belt of ammunition.

3. A cartridge according to claim 1, wherein the sub-caliber projectile can be any one or more of: a limited range training projectile, a low cost training projectile, a rubber ball, a baton, a rubber projectile, powder, or low impulse projectile.

4. A cartridge according to claim 1, wherein a case for the sub-caliber projectile case is sidably disposed with the inner bore.

5. A cartridge according to claim 5, wherein the sub-caliber projectile case is in a normally open position.

6. A cartridge according to claim 5, wherein the sub-caliber projectile case telescopes to the retracted position during chambering.

* * * * *